US005336108A

United States Patent [19]

Lin

[11] Patent Number: 5,336,108

[45] Date of Patent: Aug. 9, 1994

[54] MICROPHONE CONNECTOR

[76] Inventor: Jia S. Lin, 9F3R, No. 210, Chung Hsueh R., Tainan, Taiwan

[21] Appl. No.: 47,953

[22] Filed: Apr. 19, 1993

[51] Int. Cl.[5] ..... H01R 13/59

[52] U.S. Cl. ..... 439/462

[58] Field of Search ..... 439/461, 462

[56] References Cited

U.S. PATENT DOCUMENTS 4,647,127 3/1987 Weingartner ..... 439/289

4,657,327 4/1987 Weingartner ..... 439/289

FOREIGN PATENT DOCUMENTS 172779 2/1986 European Pat. Off. ..... 439/461

*Primary Examiner*—Gary F. Paumen

*Attorney, Agent, or Firm*—Pro-Techtor International

[57] ABSTRACT

A microphone connector comprising a connector member, a connector housing engaging with the connector member by means of a female thread and a male thread to compress a cable put through the connector member and a cable pincher so that the cable bends a little along a curved surface of the cable pincher to be sufficiently pinched therein to prevent separation of the cable from the connector member.

6 Claims, 5 Drawing Sheets

MICROPHONE CONNECTOR

BACKGROUND OF THE INVENTION

Known microphone connectors of U.S. Pat. No. 4,647,127 and 4,657,327 have a cable pinching method wherein a ring 26 engages a connector member 13, forcing a tubular clamping sleeve 7 to open its rear end 8 for clamping a cable. However, the clamping sleeve is tubular, so a great force has to be used to engage a female thread of a terminal with a housing in clamping a large diameter cable in the clamping sleeve. And continuous work of using such a great force in assembling this kind of microphone connector may compel a worker to be extremely tired. And his right thumb will feel pain or swell after working to engage thirty or forty of those connectors, and has to stop his work.

SUMMARY OF THE INVENTION

This invention has an object to offer a microphone connector with features listed below.

1. It is provided with a cable pincher shaped to conform to a connector member.
2. The cable pincher has a pinching block with an upper surface shaped as necessary and curved for a cable to lie thereon closely bending up to be tightly pinched.
3. The pinching block has two pinching points on the outer end of the upper surface to stick in the surface of a cable to reinforce of the cable.

DETAILED DESCRIPTION OF THE INVENTION

Figure 1:
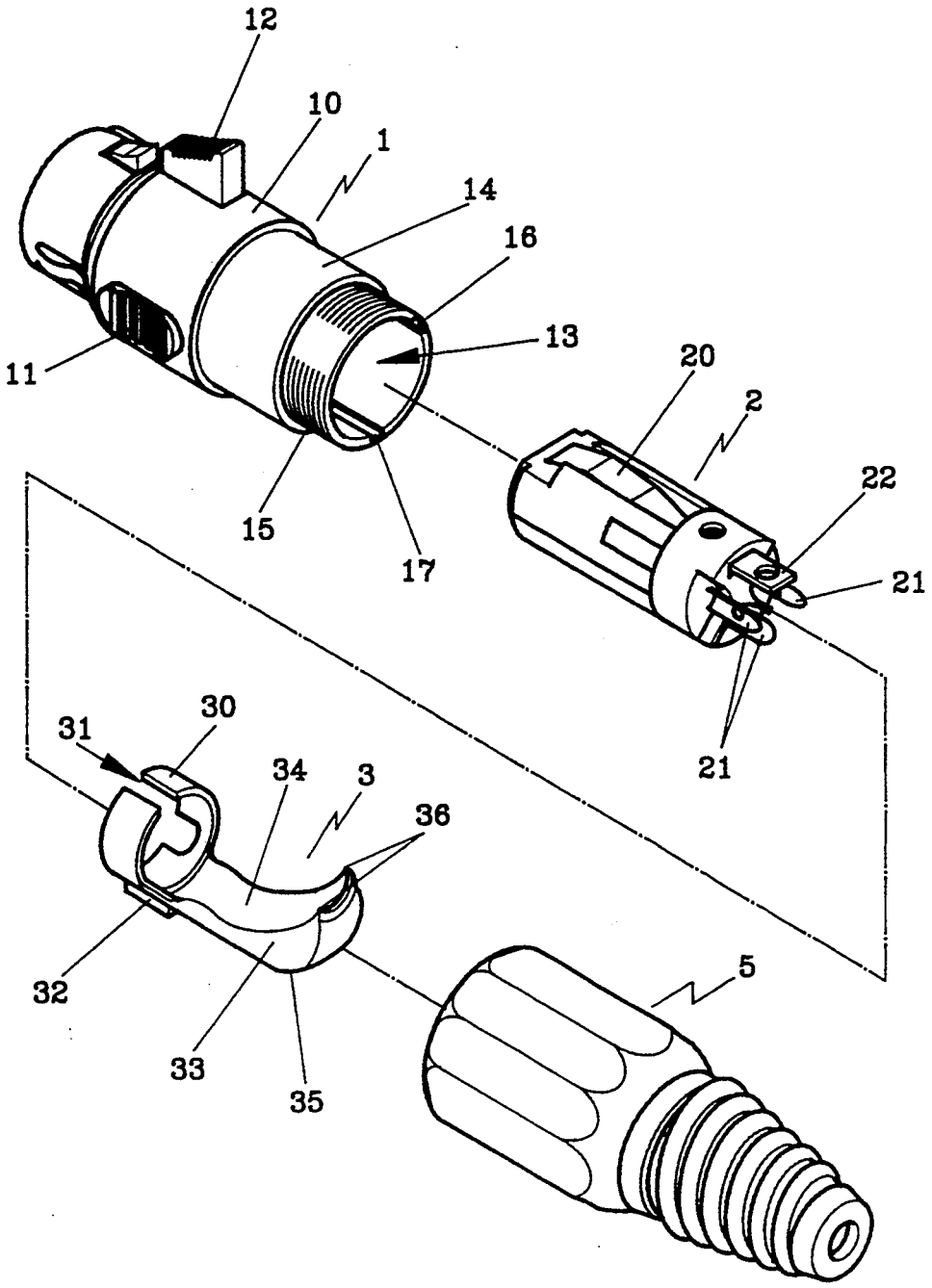
FIG. 1 is an exploded perspective view of a first embodiment of a microphone connector in-the present invention.
Figure 2:
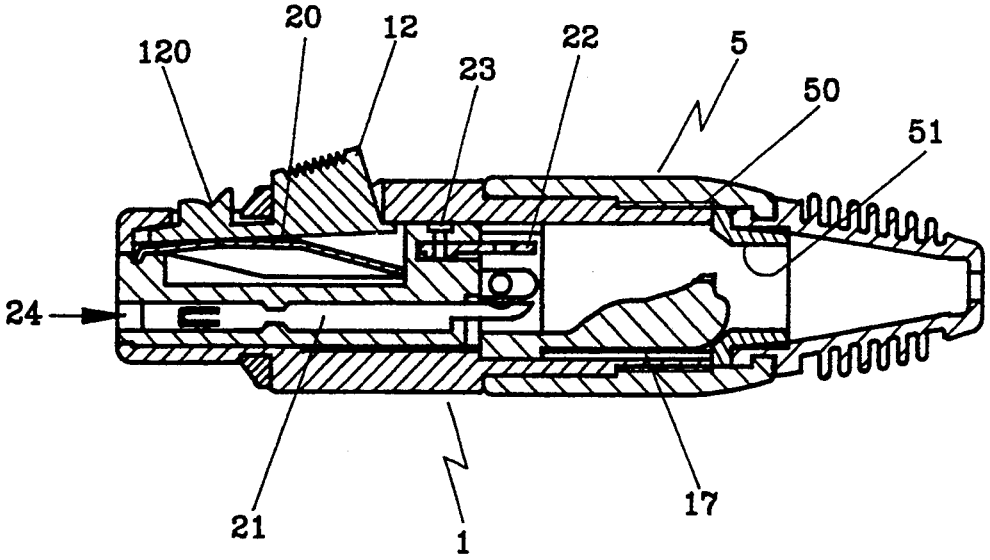
FIG. 2 is a cross-sectional view of the first embodiment of the microphone connector in the present invention.

A first embodiment of a female microphone connector in the present invention, as shown in FIGS. 1–4, comprises a connector member 1, a terminal carrier 2, a cable pincher 3 and a connector housing 5 as main components.

The connector member 1 is shaped cylindrically having a proximal hand holding surface portion 10 with opposing grips 11, for a user to grip this connector, an intermediate smooth portion 14 and a distal male-threaded portion 15, an axially extending through hole 13 for depositing the terminal carrier 2 and the cable pincher 3 therein, a push button 12 on the holding surface portion 10 and a front 120 for assembling with the connector housing 5. The intermediate smooth portion 14 is rather long and the distal male-threaded portion 15 is relatively short so that the housing 5 may be screwed on with little force. Two opposite axially extending grooves 16, 17 are provided in an inner surface of the hole 13 for the terminal carrier 2 and the cable pincher 3 to fit unrotatably straight in the hole 13.

The terminal carrier 2 is fitted in the through hole 13 of the connector member 1, having a plate spring 20 fixed axially on its surface, two terminals 21, 21 to fit in terminal holes 24, 24 a negative terminal 22 fixed on the carrier body with a bolt 23, and the end of each terminal is soldered with a wire of the cable 4.

Figure 3:
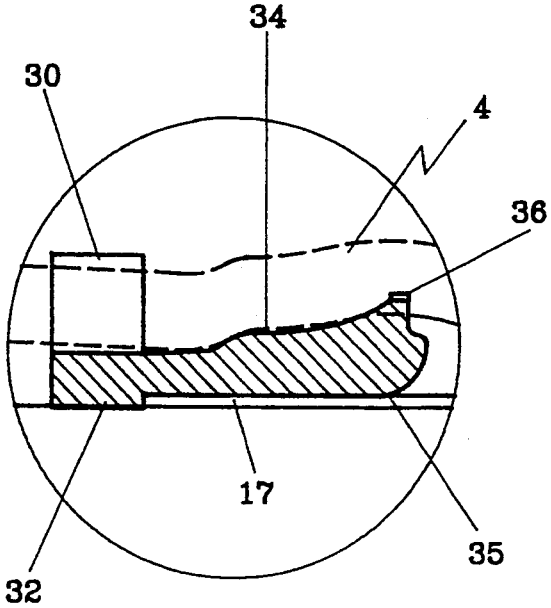
FIG. 3 is a magnified cross-sectional view of a cable pincher in the first embodiment of the microphone connector in the present invention.
Figure 4:
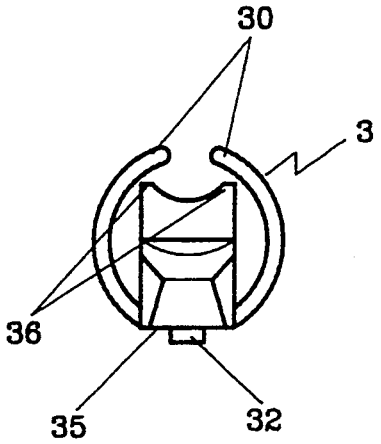
FIG. 4 is a rear view of the cable pincher in the first embodiment of the microphone connector in the present invention.

The cable pincher 3 has an annular wall 30 with a slot 31 for pinching a cable of various size therein, an engaging block 32 on the bottom wall 30 to engage with the groove 17 of the connector member 1, a pinching block 33 with an upper recessed and curved surface 34 and a curved-up end 35 and two pinching points 36, 36 on the curved-up end 35. Therefore, after the cable 4 is put through the pincher 3, the connector housing 5 is screwed onto the connector member 1, by engaging the female-thread 50 with the male 15. Then the cable 4 can be bent up a little where there is a ring 51 in the connector housing 5, as shown in FIG. 3, the cable 4 is placed through the cable pincher 3 and the connector housing 5 is screwed with the connector member 1. In addition, the pinching points 36, 36 stick in the outer surface of the cable 4, which then is hard to remove.

Figure 5:
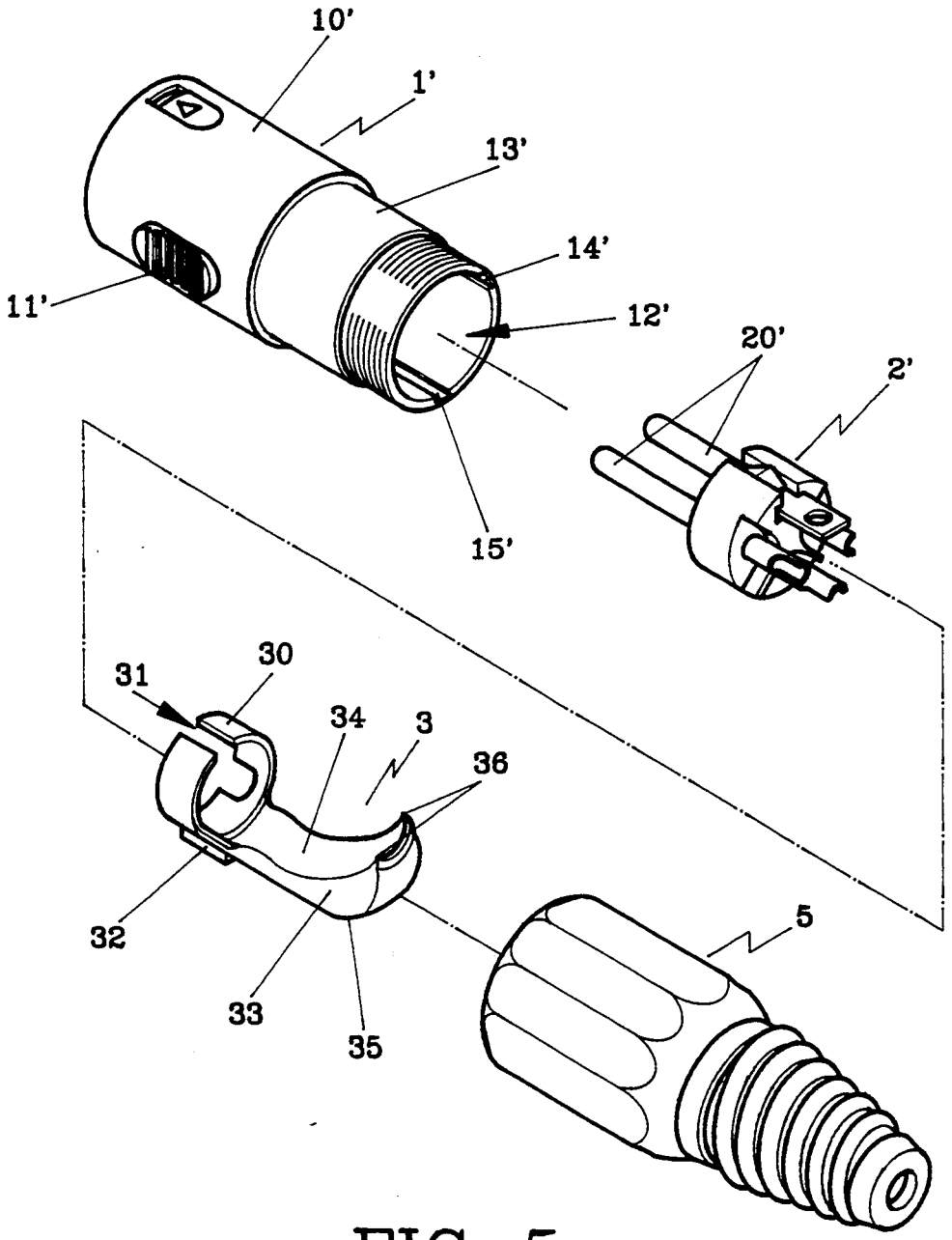
FIG. 5 is an exploded perspective view of a second embodiment of the microphone connector in the present invention.

FIG. 5 a second embodiment of a male microphone connector in the present invention, which comprises a connector member 1', carrier 2', a cable pincher 3 completely having the same structure as that of the first embodiment, and a connector housing 5 structure as that of the first embodiment. The connection member 1' is shaped cylindrical, having a proximal hand holding surface portion 10' with two opposite grips 11', 11', an intermediate smooth portion 13', a distal male-threaded portion 14', an axially extending through hole 12' and two lengthwise grooves 14', 15' in an inner surface for the terminal carrier 2' and the cable pincher 3 to fit unrotatably therein. Two terminals 20' are fixed with the terminal carrier 2' and the number of the terminals should be the same as that of the connector member 1'.

Figure 6:
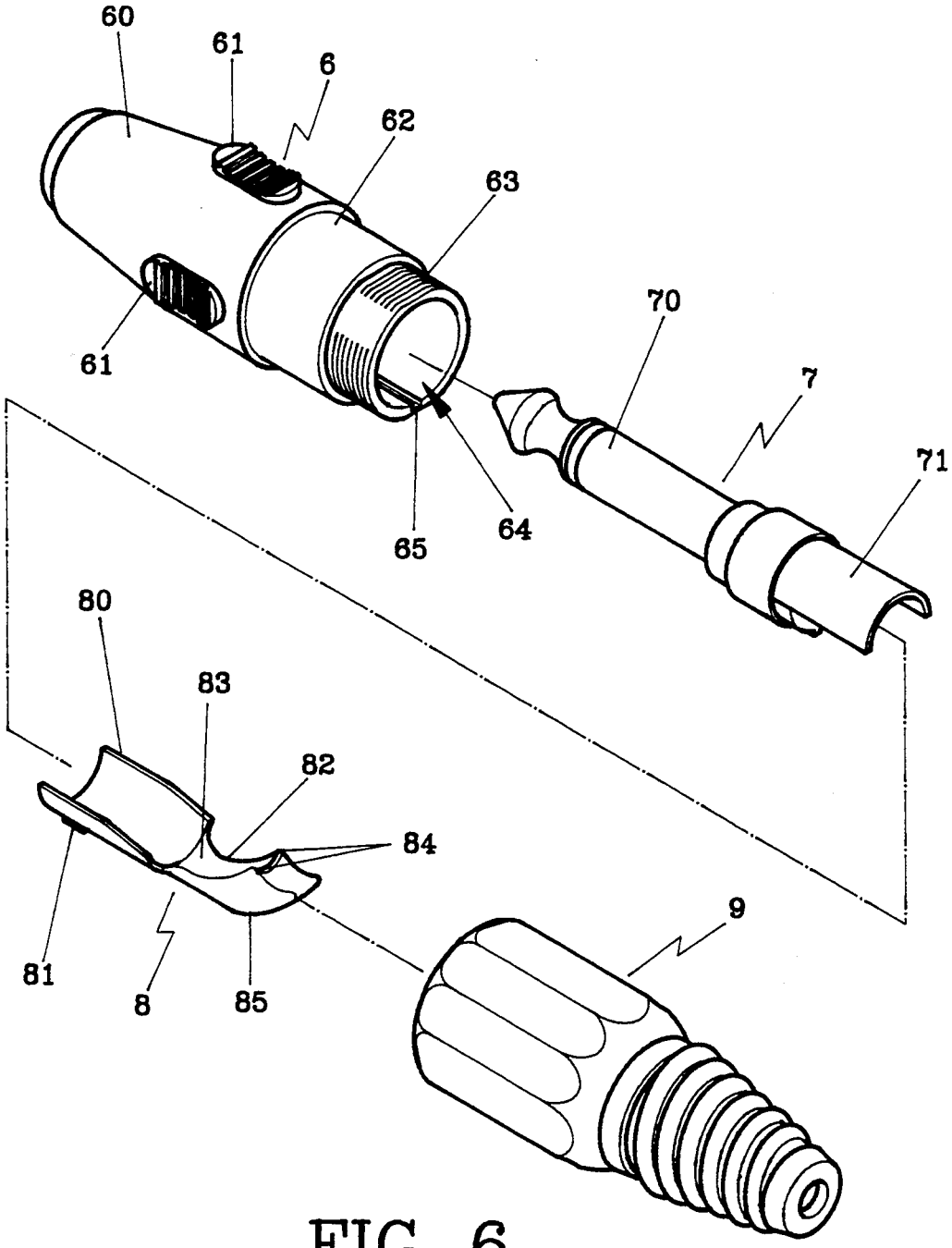
FIG. 6 is an exploded perspective view of a third embodiment of the microphone connector in the present invention.
Figure 7:
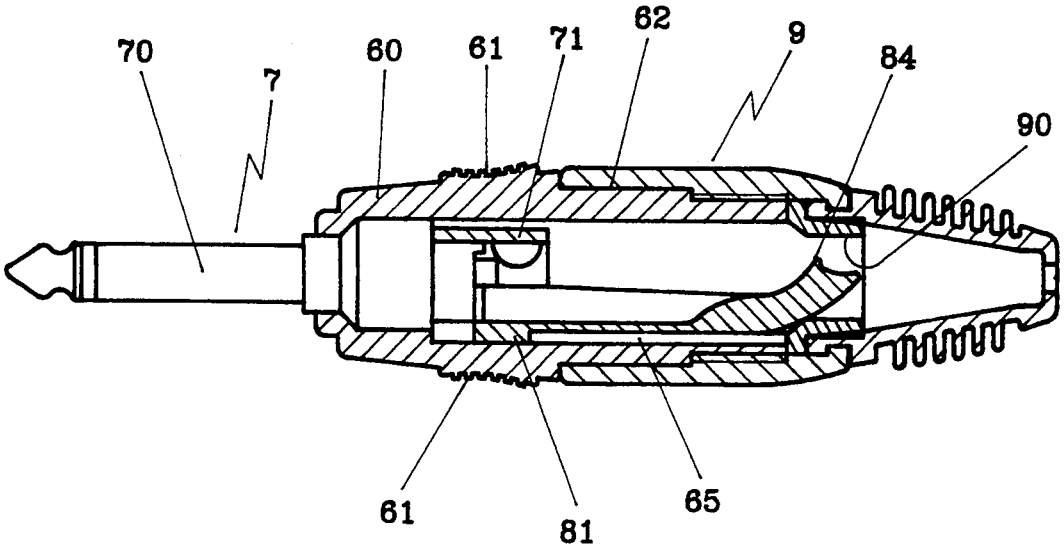
FIG. 7 is a cross-sectional view of the third embodiment of the microphone connector in the present invention.
Figure 8:
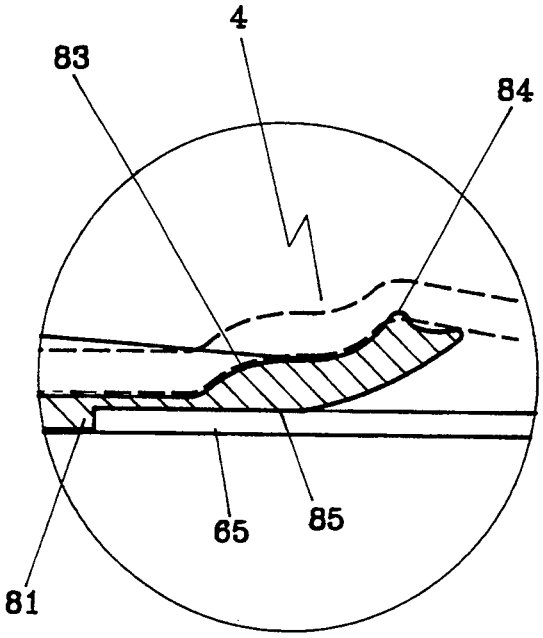
FIG. 8 is a magnified cross-sectional view of a cable pincher of the third embodiment of the microphone connector in the present invention.
Figure 9:
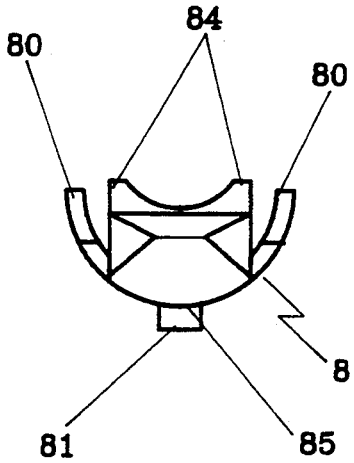
FIG. 9 is a rear view of the cable puncher in the third embodiment of the microphone connector in the present invention.

The FIGS. 6–8 show a third embodiment of a plug-in microphone connector in the present invention, which comprises a connector member 6, a plug 7, a cable pincher 8 and a connector housing 9.

The connector member 6 has a long proximal hand holding portion 60 with 4 curved grips 61 for fingers to grip thereon, an intermediate smooth portion 62 and a distal male-threaded portion 63, and an axially extending through hole 64 for an inserting portion 70 of the plug 7 to pass through, and a lengthwise groove 65 fit unrotatable therein.

The plug 7 has an inserting portion 70 and an inner semi-round end forming a cylindrical wall together with a semi-round wall 80 of the cable pincher 8 for pinching a cable therein.

The cable pincher 8 has a semi-round wall 80, a combining block 81 at a bottom to fit with the groove 65 of the connector member 6, a pinching block 82 having a recessed and curved surface 83 and two pinching points 84 on an outer end, and a curved-up bottom surface 85.

The connector housing 9 has a female-threaded portion to engage the male-threaded portion 63 of the connector member 6, a compact ring 90 urging the cable pincher 8 and to let the pinching points 84 stick in the cable 4, for attaining the purpose of pinching securely the cable 4.

What is claimed is:

1. A microphone connector comprising:

a connector member shaped cylindrically, having at least a proximal hand holding portion, an intermediate smooth portion, a distal male-threaded portion to engage a female-threaded portion of a connector housing, and an axially hole for depositing a terminal carrier or a plug and a pincher therein;

a terminal carrier shape cylindrically to fit in the through hole of said connector member, having a plate on an length-wise surface, a number of terminal holes for terminals to pass through, said terminals having one end soldered with wires of a cable;

a connector housing having a female-threaded portion to engage the male-threaded portion of the connector member and a discrete compact ring on an inner surface of the connector housing;

a cable pincher having an annular wall slot for depositing a cable of various size through the slot, a pinching block lengthwise from the wall having a recessed and surface and two pinching on an outer end thereof, and upper and bottom surfaces gradually curving up to the outer end; and said compact ring in said connector housing compressing the upper surface of said cable pincher after the connector housing is combined with the connector member, said pinching points of the pincher then sticking in the surface of said cable and said cable being forced to bend up a little according to the curvature of said pinching block of the cable pincher so that the cable pincher may sufficiently pinch the cable immovable and inseparable.

2. The microphone connector as claimed in claim 1, wherein said cable pincher is provided with vertical semi-round wall to coordinate with semi-round surface of said plug for pinching said cable.

3. The microphone connector as claimed in claim 1, wherein said cable pincher has a pinching block with an upper surface shaped as recessed and curved to conform to a round outer surface of said cable.

4. The microphone connector as claimed in claim 1, wherein said cable is compressed by said compact ring of the connector housing and said cable pincher bending inward slightly to be pinched very effectively.

5. The microphone connector as claimed in claim 1, wherein said proximal hand holding portion of the connector member has more than two grips.

6. The microphone connector as claimed in claim 1, wherein said intermediate smooth portion is longer than said distal male-threaded portion.

* * * * *